US007617564B2

(12) United States Patent
Stuthers et al.

(10) Patent No.: US 7,617,564 B2
(45) Date of Patent: Nov. 17, 2009

(54) DUAL PURPOSE FLOOR CLEANING APPARATUS AND METHOD OF USE

(75) Inventors: Billy Joe Stuthers, Garfield, AR (US); Leonard Wayne Rowan, Westville, OK (US); Shawn Wright, Stilwell, OK (US); Emert R. Whitaker, Siloam Springs, AR (US)

(73) Assignee: Alto U.S. Inc., Springdale, AR (US)

( * ) Notice: Subject to any disclaimer, the term of this patent is extended or adjusted under 35 U.S.C. 154(b) by 825 days.

(21) Appl. No.: 11/163,110

(22) Filed: Oct. 5, 2005

(65) Prior Publication Data

US 2007/0074369 A1 Apr. 5, 2007

(51) Int. Cl.
*A47L 7/00* (2006.01)

(52) U.S. Cl. ..... 15/322; 15/245; 15/401

(58) Field of Classification Search ..... 15/322, 15/401, 245; *A47L 7/00, 9/06*
See application file for complete search history.

(56) References Cited

U.S. PATENT DOCUMENTS

| | | | | |
|---|---|---|---|---|
| 2,531,370 | A | 11/1950 | Thompson | |
| 2,867,835 | A | 1/1959 | Brown, Jr. et al. | |
| 3,069,716 | A | 12/1962 | Smith | |
| 3,795,933 | A | 3/1974 | Seufert | |
| 4,270,238 | A | 6/1981 | Shallenberg et al. | |
| 4,596,061 | A * | 6/1986 | Henning | 15/322 |
| 4,864,681 | A | 9/1989 | Hult et al. | |
| 4,893,375 | A | 1/1990 | Girman et al. | |
| D307,517 | S | 5/1990 | Mallory et al. | |
| 5,184,372 | A | 2/1993 | Mache | |
| 5,657,509 | A * | 8/1997 | Trautloff et al. | 15/321 |
| 6,055,699 | A * | 5/2000 | Cho | 15/321 |
| 6,263,539 | B1 | 7/2001 | Baig | |
| 6,279,198 | B1 | 8/2001 | Martin et al. | |
| 6,560,818 | B1 | 5/2003 | Hasko | |
| 6,647,585 | B1 | 11/2003 | Robinson | |
| 6,735,812 | B2 | 5/2004 | Hekman et al. | |
| D508,154 | S | 8/2005 | Carr | |
| 7,406,739 | B2 * | 8/2008 | Guest et al. | 15/49.1 |
| 2005/0144752 | A1 | 7/2005 | You et al. | |

OTHER PUBLICATIONS

Alto/Clarke Technology; "Operator's Manual—BEXT-150, 150H, 300HV Extractor's"; Manual; Jan. 2002; pp. 1-16; Alto U.S. Inc., Springdale, Arkansas.

Alto/Clarke Technology; "Parts and Service Manual—BEXT-150, 150H, 300HV Extractor"; Manual; Date Unknown; pp. 18-28; Alto U.S. Inc., Springdale, Arkansas.

* cited by examiner

*Primary Examiner*—David A Redding
(74) *Attorney, Agent, or Firm*—Husch Blackwell Sanders LLP

(57) ABSTRACT

In combination, a removable tool may be selectively attached to the cleaning wand of a carpet extractor to alternatively clean hard surfaced floors, such as grouted tile and when not attached, clean carpeted floors. The removable tool may be sold as an aftermarket item for existing carpet extractors. A method of using the carpet extractor with the removable tool allows the apparatus to fulfill dual purposes, e.g., cleaning hard surfaced floors and when the tool is attached to the cleaning wand, and when the tool is removed from the wand to clean carpeted floors.

11 Claims, 8 Drawing Sheets

DUAL PURPOSE FLOOR CLEANING APPARATUS AND METHOD OF USE

BACKGROUND OF THE INVENTION

This invention is a dual purpose floor cleaning apparatus and method of use. The apparatus is dual purpose because it can clean carpeted floors and hard surfaced floors, such as grouted tile. The invention also includes a removable tool that can be attached to a conventional carpet extractor to allow the apparatus to clean hard surfaced floors in addition to carpeted floors. The tool may also be sold as an aftermarket device for existing carpet extractors.

Conventional carpet extractors such as the Bext extractors sold by Clarke include a body, a cleaning wand that the operator moves back and forth over the carpeted floor and conduits connecting the wand to the body. Unfortunately, these extractors do not have a brush on the wand, so they are unsuitable for hard surfaced floors including grouted tile. Attached in the Information Disclosure Statement, and incorporated herein by reference, are an Operator's Manual and a Parts and Service Manual for these Bext carpet extractors sold by Clarke/ALTO.

One solution to this problem is to buy a second wand with a brush and squeegee to clean hard surfaced floors. However, it is inconvenient for the operator to carry around two wands and additional capital costs are incurred.

Another solution to this problem is a "flipper" apparatus as disclosed in U.S. Pat. No. 4,893,375 assigned to Hako Minuteman, Inc., one of the many competitors in the floor cleaning business. This "flipper" has a rotatable cleaning head with a brush on one side and a vacuum pickup on the opposite side. To clean carpeted floors, the vacuum pickup is in contact with the floor surface. To clean hard surfaced floors, the cleaning head is rotated 180° so the brush is in contact with the floor surface. After scrubbing, the cleaning head is again rotated 180° so the dirty solution may be vacuumed from the floor surface.

There is still a need for a better dual purpose apparatus that can clean both carpeted and hard surfaced floors.

SUMMARY OF THE INVENTION

The present invention is a removable tool that can be slipped over the cleaning head of a conventional carpet extractor to enable the conventional apparatus to perform the dual purpose of cleaning carpeted floors and hard surfaced floors. The removable tool may be sold as an aftermarket item for existing carpet extractors or it may be sold in combination with new carpet extractors so the new extractor can be used to clean hard surfaced floors and carpeted floors.

The removable tool has a squeegee and a brush to scrub the grout of tiled floors and other features of hard surfaced floors. The removable tool slips over the cleaning head of a conventional carpet extractor which can selectively spray cleaning solution and vacuum up the dirty solution. The squeegee of the present invention fits around the vacuum shoe of the conventional carpet extractor head to facilitate better pickup of dirty solution from hard surfaced floors. The brush permits aggressive scrubbing of a hard surfaced floor.

The present invention requires only one cleaning wand and a removable tool to clean both carpeted floors and hard surfaced floors. The removable tool is small enough for the operator to carry it around and slip it over the cleaning wand when needed. This eliminates the need to carry around a second wand or to be continually stopping to rotate the "flipper" of the apparatus disclosed in the '375 patent mentioned above. The removable tool may be manufactured with minimum clearance to grip the cleaning head of a conventional cleaning wand; or the attachment may be augmented with springs, clips or other suitable fastening means.

DETAILED DESCRIPTION OF THE INVENTION

Figure 1:
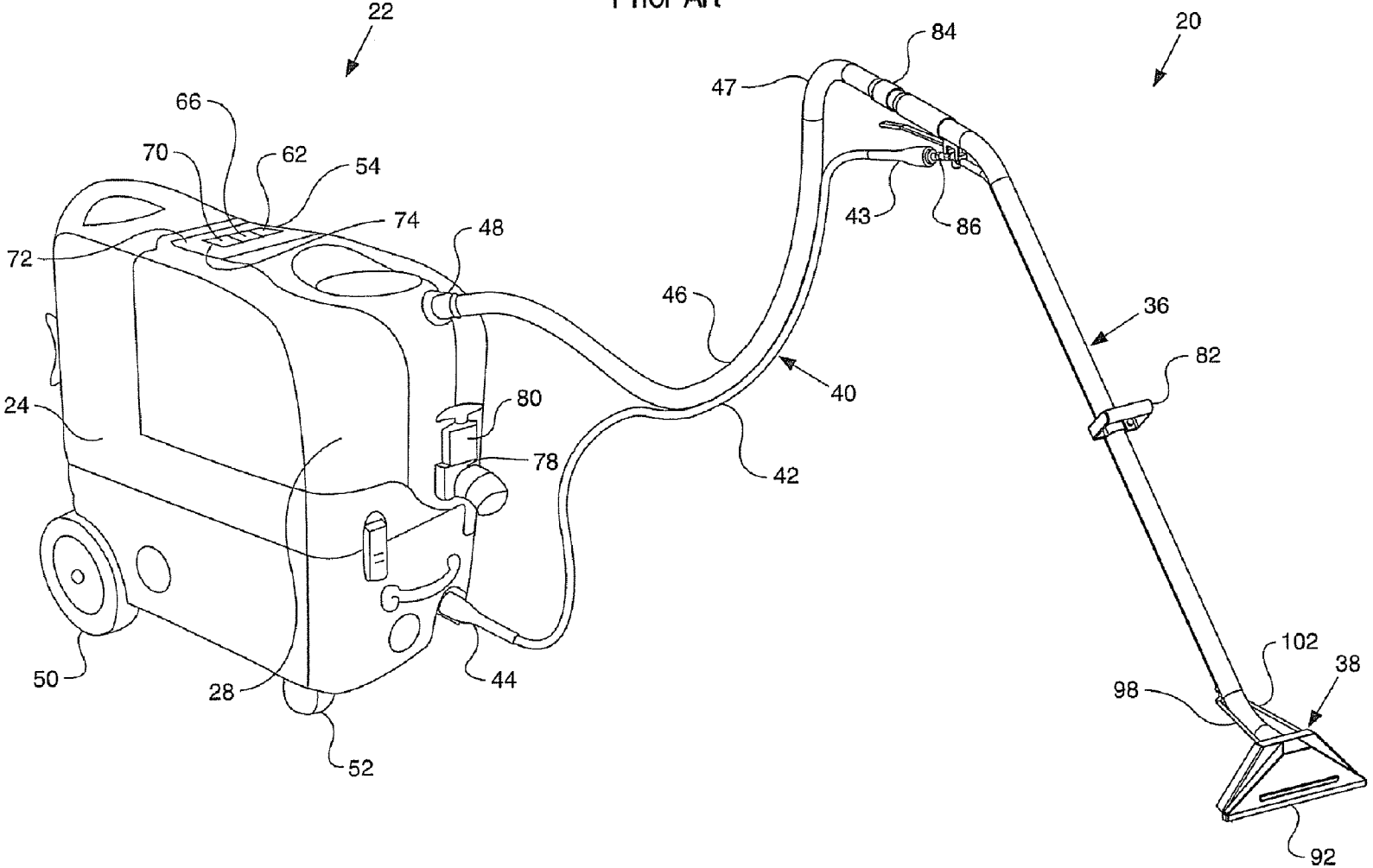
Fig. 1 Prior Art
FIG. 1 is a perspective view of a prior art carpet extractor with a single cleaning purpose wand.
Figure 2:
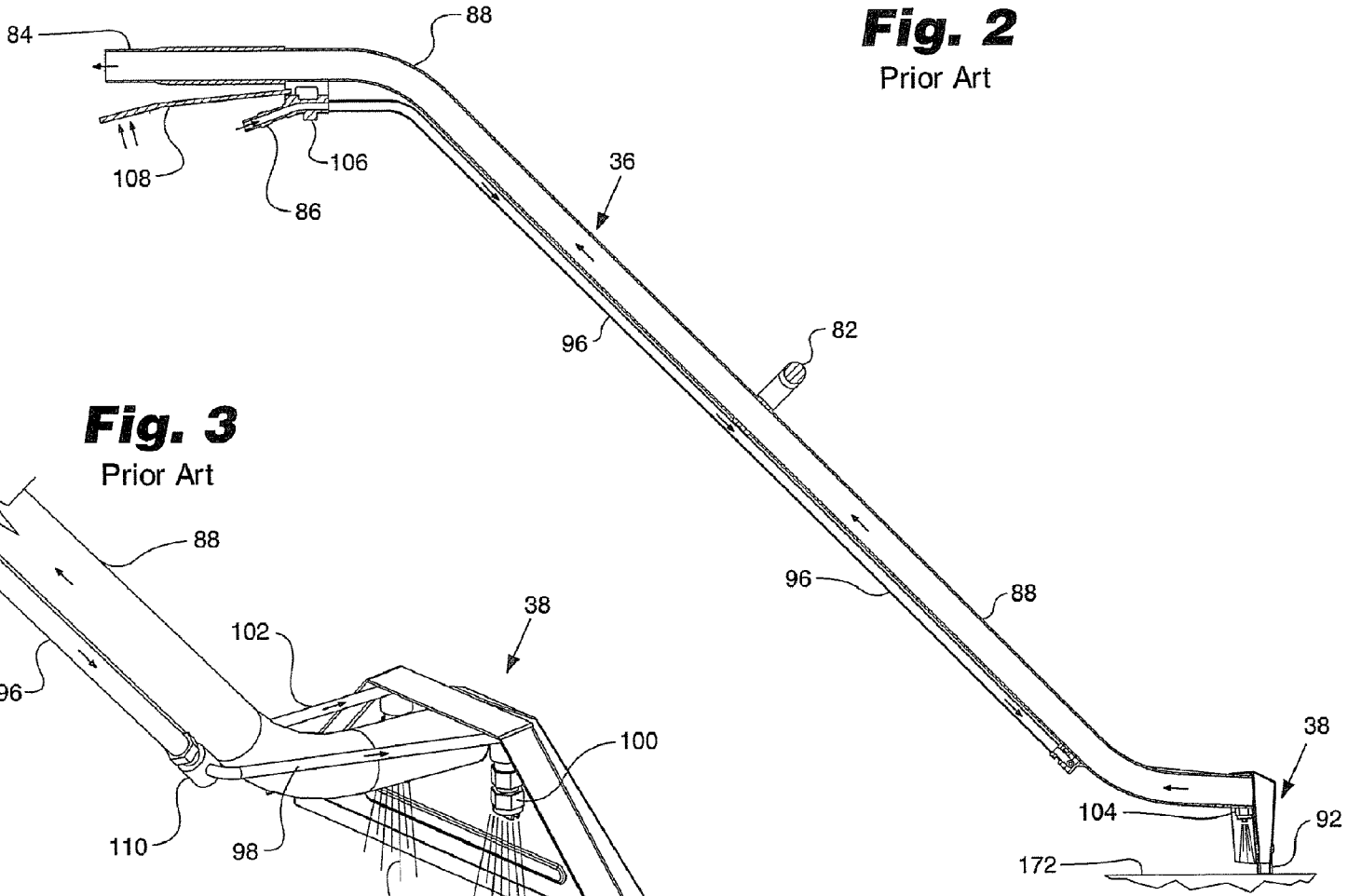
Fig. 2 Prior Art
FIG. 2 is a cross section of the prior art single purpose carpet cleaning wand of FIG. 1.
Figure 3:
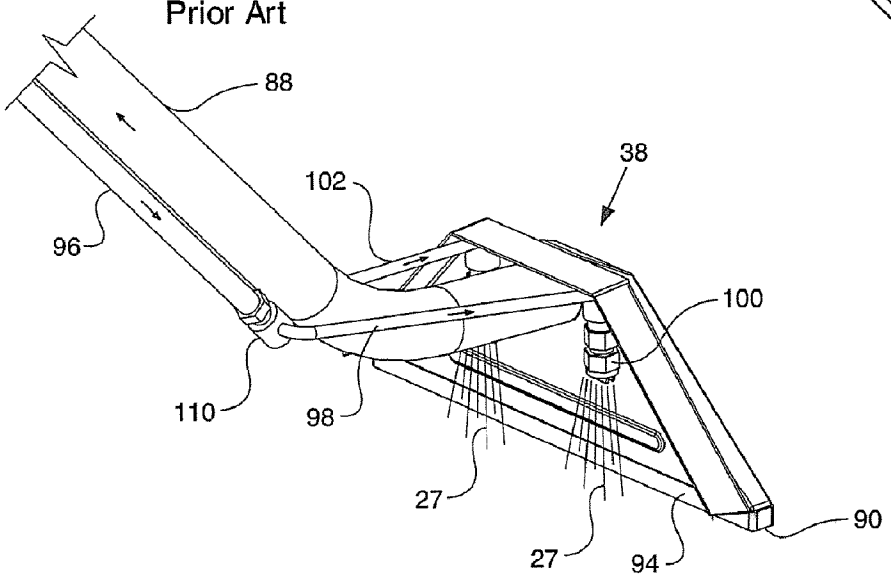
Fig. 3 Prior Art
FIG. 3 is a perspective of the prior art cleaning head of the wand of FIG. 1 viewed from the rear.
Figure 4:
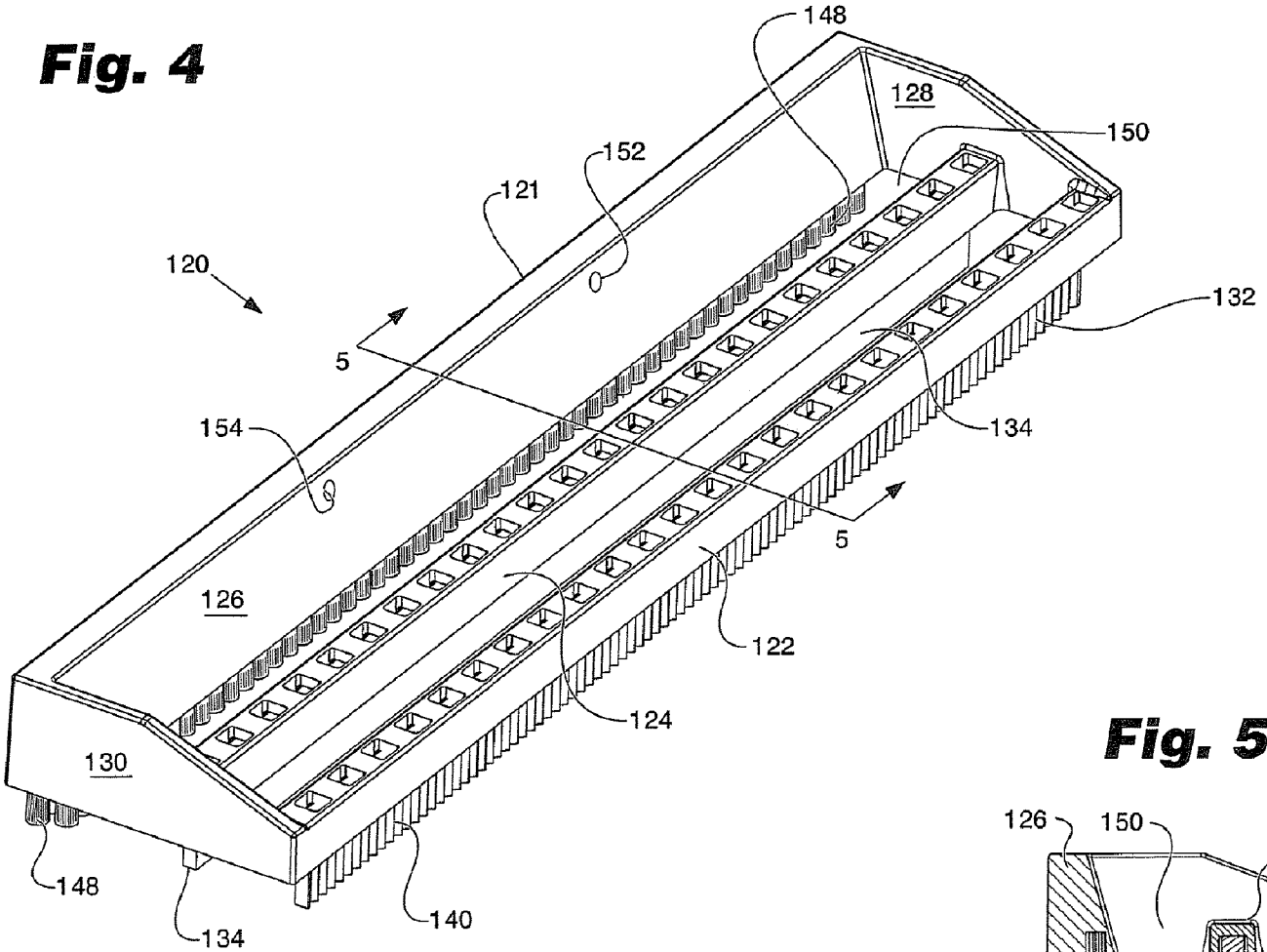
FIG. 4 is a perspective view of the removable cleaning tool for hard surfaced floors of the present invention.
Figure 5:
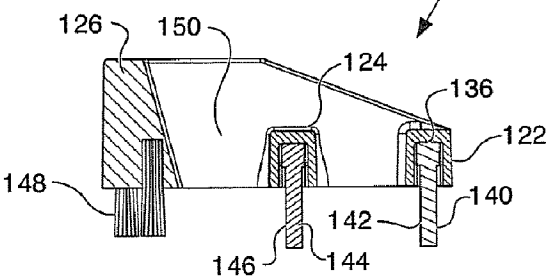
FIG. 5 is a section view of the removable cleaning tool for hard surfaced floors along the line 5-5 of FIG. 4.
Figure 6:
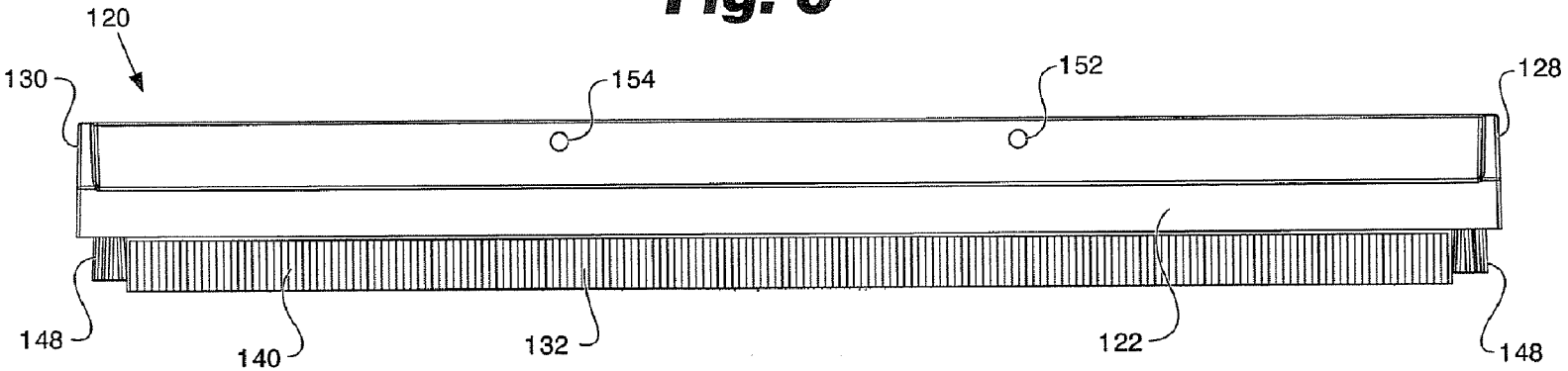
FIG. 6 is a front view of the removable cleaning tool of FIG. 4.
Figure 7:
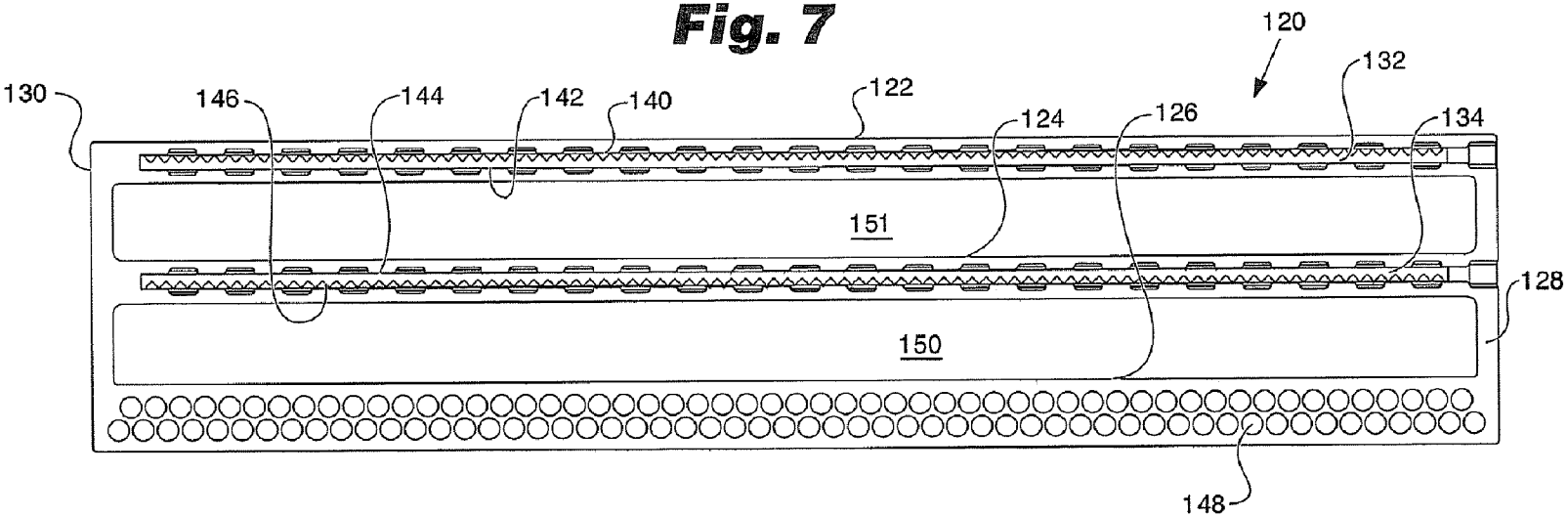
FIG. 7 is a bottom view of the removable cleaning tool of FIG. 4.

Referring now to FIGS. 1, 2 and 3, a prior art carpet extractor is generally identified by the numeral 20. The carpet extractor includes a movable housing 22 which can be moved about by the operator, not shown. The housing includes a solution tank 24 for the cleaning solution, better seen in FIG. 1. The housing also includes a recovery tank 28 for the dirty solution. The housing further includes at least one pump, not shown for the cleaning solution and at least one vacuum pump, not shown.

A cleaning wand, generally identified by the numeral 36 has a cleaning head 38 and is connected to the housing 22 by flexible conduits 40. The conduits 40 include a first conduit 42 for the cleaning solution which connects to the housing at the cleaning solution conduit connector 44. The second conduit 46 is a vacuum conduit and connects to the housing at the vacuum conduit connector 48. The housing has a first wheel 50, a second wheel 52 and others, not shown, which allow the carpet extractor to be pulled or pushed by the operator around the floor, as needed.

A control panel 54 on the housing allows the operator to actuate the various components of the prior art carpet extractor. But first, the operator must plug in a machine power cord, not shown. Some embodiments of the prior art carpet extractor also include a heater for the cleaning solution. Those embodiments with a heater also include a heater power cord.

A heater switch 62 is also located on the control panel to turn the heater on and off. A cleaning solution pump switch 66 is located on the control panel to turn this pump on and off. A vacuum motor switch 70 is on the control panel to turn the vacuum motor on and off. Some machines may include a circuit locator 72 that indicates if the machine power cord and the heater power cord are plugged into different circuits. When the heater is in use, it is preferable to plug the machine power cord in one circuit and the heater power cord in another circuit to prevent unwanted tripping of circuit breakers. Those embodiments with a heater may also include a heat mode indicator 74 which indicates when the heater has fully heated the cleaning solution.

A mechanical float assembly, not shown, is located in the recovery tank to turn off the vacuum motor when the recovery tank is full. This prevents overflows of dirty solution from the recovery tank. A drain 78 is connected to the recovery tank to allow easy draining of the dirty solution. A drain valve 80 opens and closes the passageway from the recovery tank to the drain.

The cleaning wand 36 has a handle 82 that can be gripped by the operator to help move the wand back and forth across the floor surface. The cleaning wand 36 has a vacuum conduit 88 with a vacuum conduit connector 84 on end 47 and the cleaning head 38 on the other end. A vacuum shoe 90 is formed on the cleaning head and the vacuum shoe defines an elongate leading edge 92 and an elongate trailing edge 94. The cleaning wand 36 also has a cleaning solution conduit 96 with a cleaning solution conduit connector on end 86. On the opposite end 110 of the cleaning solution conduit 96 is a right branching conduit 98 in fluid communication with a right spray nozzle 100 and a left branching conduit 102 in fluid communication with a left spray nozzle 104. Cleaning solution spray 27 leaves the spray nozzles and contacts the floor surface.

The prior art carpet extractor 22 operates as follows. The solution tank is filled with water and a cleaning agent to form the cleaning solution. The extractor is taken to a carpeted floor for cleaning. The operator plugs in the machine power cord and for a heated unit the heater power cord. At least one vacuum pump is turned on and at least one solution pump is turned on. The operator moves the wand back and forth across the carpeted floor, and depresses the handle of the cleaning solution valve to selectively spray cleaning solution through the nozzles, as needed onto the carpeted floor surface. The cleaning solution travels from the solution tank, through the pump, through the flexible cleaning solution conduit, the wand and ultimately to the nozzles. Generally, the operator sprays some cleaning solution on the carpeted surface and then moves the wand back and forth to pick up the dirty solution.

In other words, the spray is generally not in constant use. However, negative pressure is constantly pulled on the vacuum shoe to pick up the dirty solution. The vacuum pump creates the negative pressure or suction in the recovery tank. The negative pressure, sometimes referred to in the industry as vacuum, is pulled on the flexible vacuum conduit, the wand and ultimately the vacuum shoe 90. This pulls the dirty solution from the carpeted floor back to the recovery tank. So the method is typically as follows: spray a little cleaning solution on the carpeted floor surface while moving the wand back and forth, stop spraying and continue moving the wand back and forth to vacuum up the dirty solution. The operator then moves to another carpeted area and repeats the process. The carpeted floor surface is then left to dry and is thereafter vacuumed using a conventional vacuum cleaner, not this prior art carpet extractor. Those skilled in the art are familiar with conventional carpet extractors such as the apparatus described above.

Referring now to FIGS. 4-7, the removable tool 120 for cleaning hard surfaced floors is sized and arranged to slip over a portion of the cleaning head 38. The tool 120 has a generally rectangular body 121 that includes a front bar 122, a middle bar 124, and a rear bar 126. The three bars are connected by a left side wall 128 and a right side wall 130. The tool 120 includes a removable front elongate elastomeric squeegee blade 132 and a removable rear elongate elastomeric squeegee blade 134. The front bar 122 forms a generally unshaped channel sized and arranged to engage the front squeegee blade 132 and the middle bar 124 forms a generally unshaped channel sized and arranged to engage the rear squeegee blade 134. The leading edge 140 of the front squeegee blade is formed into a wavy pattern and the trailing edge 142 of the front squeegee blade is generally flat. The leading edge 144 of the rear squeegee blade is formed into a generally flat surface and the trailing edge 146 is formed into a wavy pattern. This arrangement allows dirty solution to flow under the wavy pattern on the leading edge of the front blade and be collected by the flat surface of the leading edge of the rear blade when the wand is moved forward relative to the operator. Likewise when the wand is pulled backward relative to the operator, this arrangement allows dirty solution to flow under the wavy pattern of the trailing edge of the rear blade and be collected by the flat surface of the front blade. So the front and rear squeegee blades which slip around the vacuum shoe 90 are always sucking up dirty solution from the hard surfaced floor.

A plurality of brushes 148 are attached to the rear bar 126. These bristles may be offset for greater cleaning effect. A spray slot 150 is formed between the middle bar 124 and the rear bar 126. The cleaning solution which is sprayed from the nozzles 100 and 104 passes through the spray slot 150 to contact the hard surfaced floor. A vacuum slot 151 is formed between the middle bar 124, the front bar 122, the left side wall 128 and the right side wall 130. The vacuum slot 151 is shaped and arranged to slip over and grip the vacuum shoe 90 of the cleaning head 38. A left aperture 152 is formed in the rear bar 126 on the side near the left side panel 128 and a right aperture 154 is formed in the rear bar 126 on the side near the right side panel.

Figure 9:
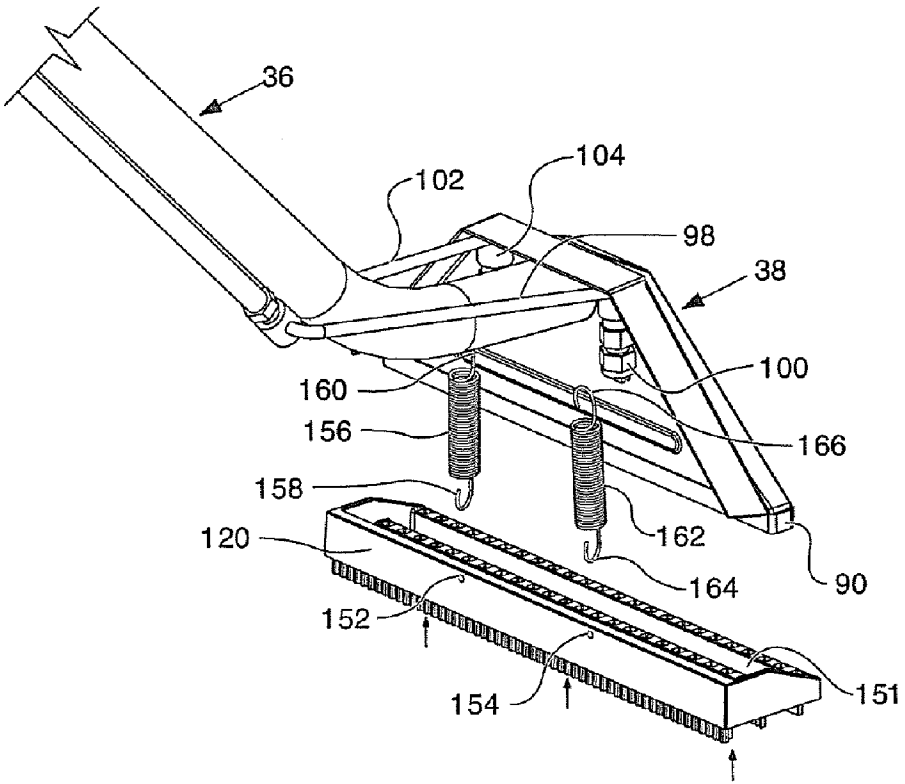
FIG. 9 is an exploded perspective view of the cleaning head of FIG. 3 and the removable cleaning tool of FIG. 4 viewed from the rear. In this view, the removable cleaning tool is separated from the cleaning head.
Figure 8:
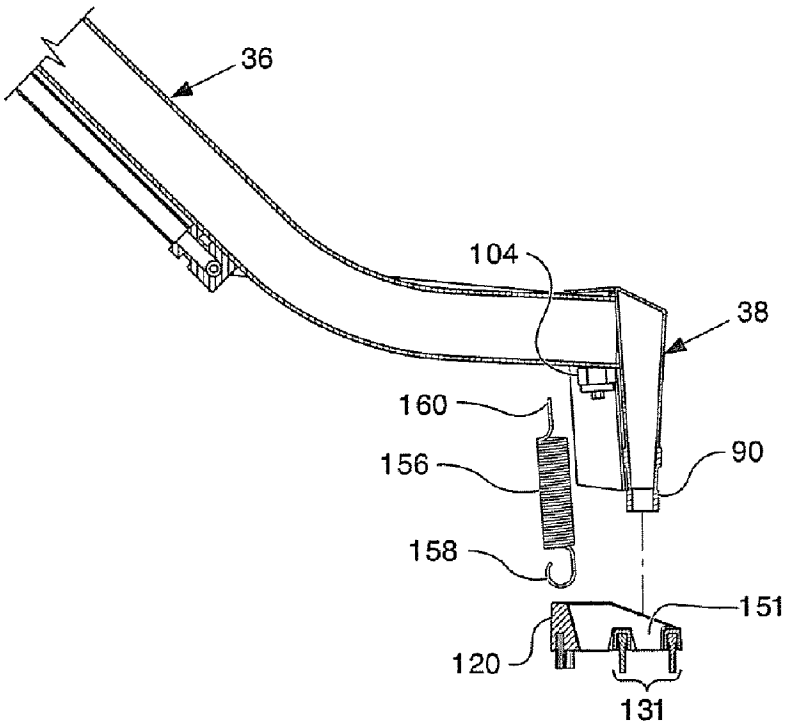
FIG. 8 is a cross sectional exploded view of the cleaning head of FIG. 2 and the removable cleaning tool of FIG. 5. In this view, the removable cleaning tool is separated from the cleaning head.

Referring now to FIGS. 8 and 9, the tool for cleaning hard surfaced floors 120 is shown removed from the cleaning head 38 of the wand 36. The arrows in the drawings show how the removable tool 120 is slipped over the cleaning head 38 of the wand 36 to convert the carpet cleaning wand into a device that is suitable for cleaning hard surfaced floors. A brush is necessary to scrub a hard surfaced floor, but is not typically used on carpeted floors. A squeegee is helpful to pick up dirty solution from a hard surface floor, but a vacuum shoe is generally all that is used on a carpeted floor.

A left spring 156 forms a lower end 158 for engagement with left aperture 152 and an upper end 160 for engagement with the left branching conduit 102. The right spring 162 forms a lower end 164 for engagement with right aperture 154 and an upper end 166 for engagement with the right branching conduit 98. These springs are helpful, but not essential to keep the removable tool 120 secured to the head of the cleaning wand. If the tolerances are kept to a minimum the grip of the vacuum shoe by the first bar, the middle bar, the left sidewall and the right sidewall will hold the tool 120 on the head of the cleaning wand.

Figure 11:
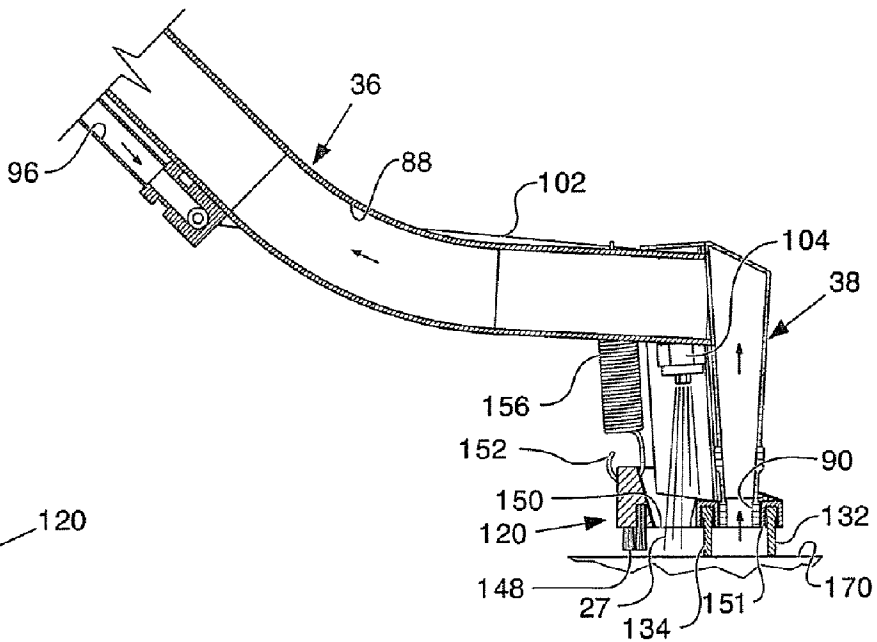
FIG. 11 is a section view of the cleaning tool mounted on the cleaning head of the wand.
Figure 10:
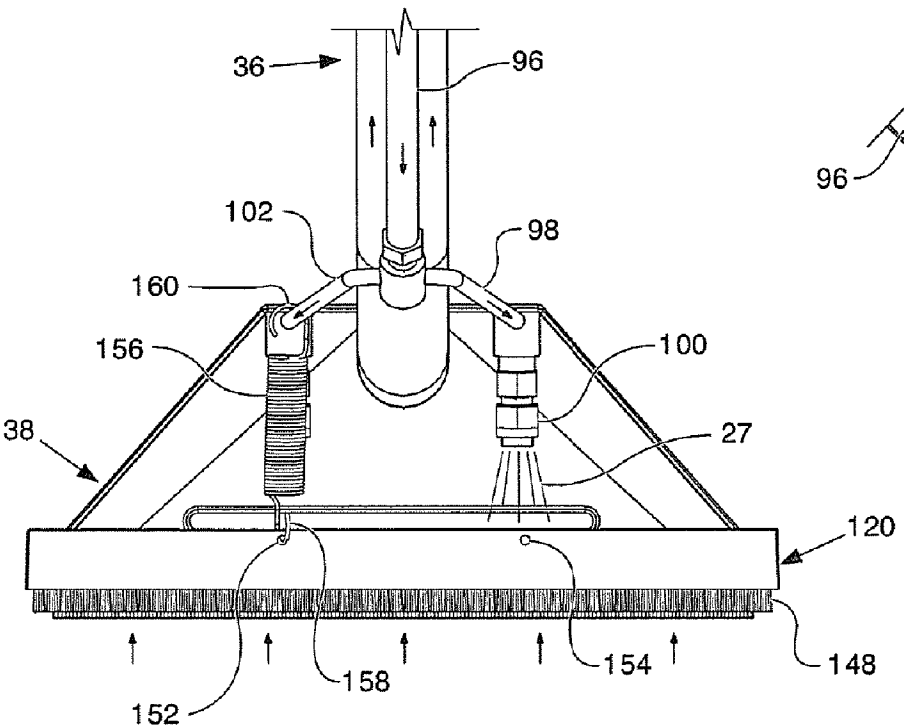
FIG. 10 is a rear perspective view of the cleaning tool mounted on the cleaning head of the wand. One spring has been removed to better see the cleaning solution spray head.
Figure 12:
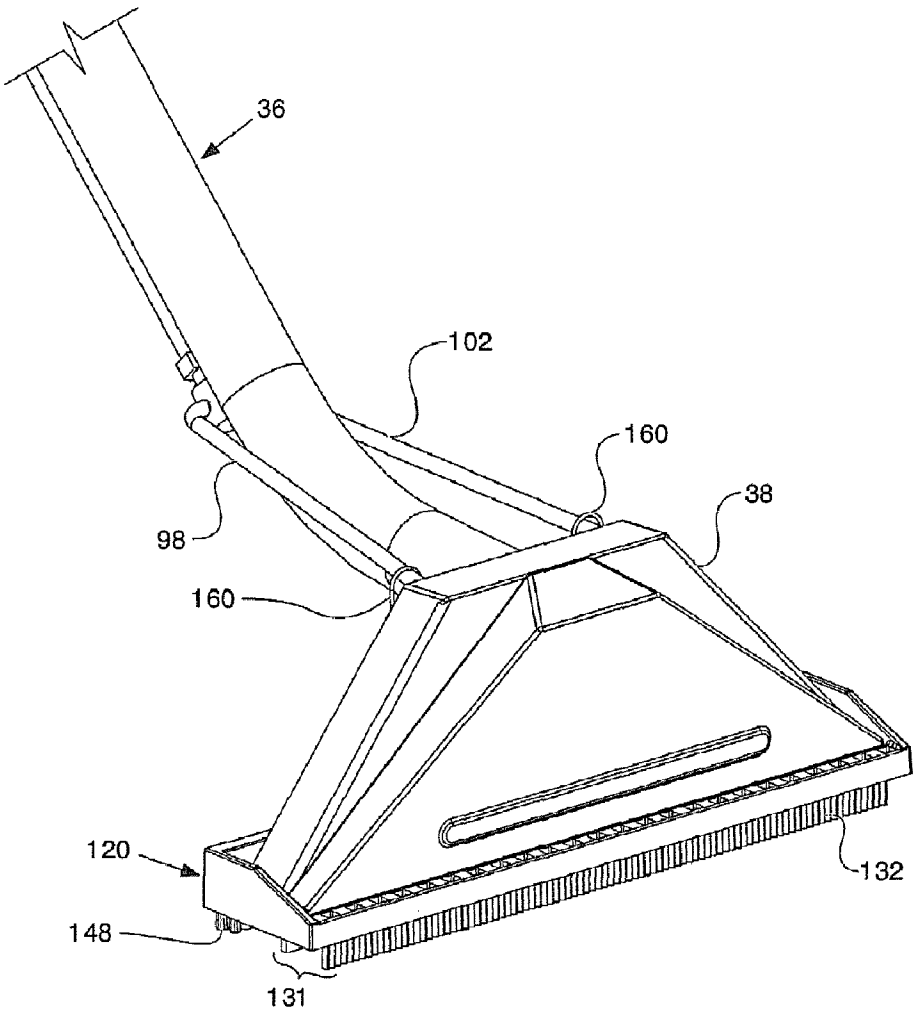
FIG. 12 is a front perspective view of the cleaning tool mounted on the cleaning head of the wand.

Referring now to FIGS. 10, 11 and 12, the tool 120 has been slipped over the cleaning head 38 of the cleaning wand 36. The upper end 160 of left spring 156 has been slipped over the left branching cleaning solution conduit and the lower end 158 has been slipped in the left aperture 152 to help hold the tool 120 on the cleaning head 38. Likewise, the upper end 166 of the right spring 162, not shown in these figures, has been slipped over the right branching cleaning solution conduit 98 and the lower end 164, not shown in these figures has been slipped in the right aperture, 154, not shown in these figures to help hold the tool 120 on the cleaning head 38. Again, the springs are optional.

When the tool 120 is slipped over the cleaning head 38 of the cleaning wand 36, the apparatus is ready to clean a hard surface floor 170 as shown in FIG. 11. The flow arrows in the cleaning solution conduit 96, the left branching conduit 102 and the right branching conduit 98 show the flow of cleaning solution to the left and right spray nozzles. In FIGS. 10 and 11, the spray 27 of the cleaning solution exits the left nozzle 104 and the right spray nozzle 100 and passes through the spray slot 150 in the tool 120 to contact the hard surface floor 170. The wand is then moved back and forth across the hard floor surface 170 to scrub the surface 170 with the brushes 148 and to vacuum up dirty solution with the squeegee assembly 131 as shown by the flow arrows. The dirty solution is picked up by the squeegee assembly 131, which includes the front squeegee blade and the rear squeegee blade. The dirty solution passes through the vacuum shoe 90, through the cleaning head 38 and through the vacuum conduit 88 as shown by the flow arrows. The dirty solution is held in the recovery tank in the extractor 20 as better seen in FIG. 1. When it is time to go back to cleaning a carpeted floor surface, the operator slips the tool 120 off the cleaning head 38 and uses the wand 36 to clean the carpeted floor surface 172 as better seen in FIG. 2.

Figure 13:
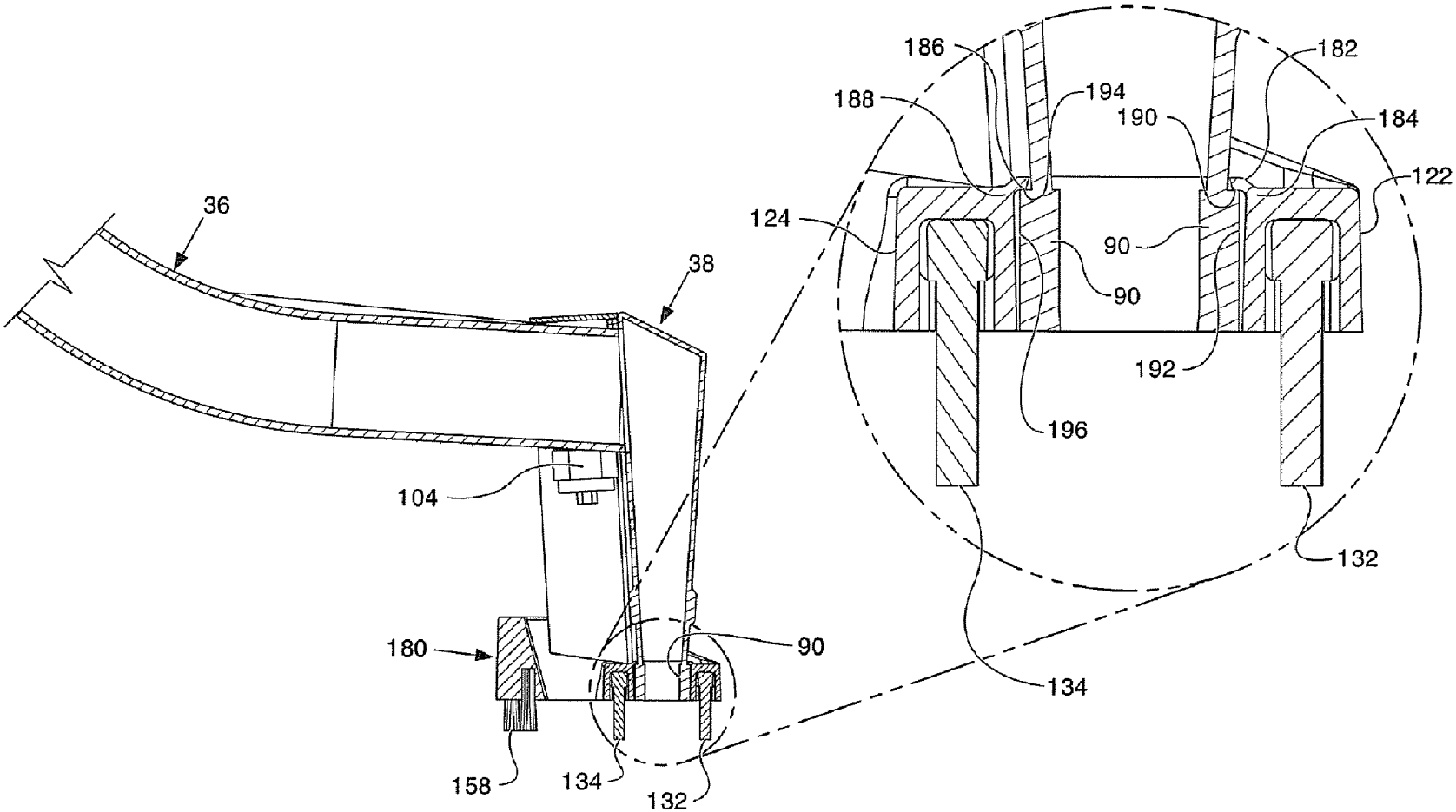
FIG. 13 is an enlarged section view of an alternative embodiment of the removable cleaning tool mounted on the cleaning head of the cleaning wand.

FIG. 13 is an enlarged section view of an alternative embodiment of the removable cleaning tool 180 mounted on the cleaning head 38 of the wand 36. Like structure will be identified by like numerals. A front elongate clip 182 is formed on a trailing edge 184 of the front bar 122. A rear elongate clip 186 is formed on a leading edge 188 of the middle bar 124. A front shoulder 190 is formed on the leading edge 192 of the vacuum shoe 90 and a rear shoulder 194 is formed on the trailing edge 196 of the vacuum shoe 90. As shown in the enlargement of FIG. 13, the front clip 182 slips over and engages the front shoulder 190 of the vacuum shoe 90. Likewise, the rear clip 186 slips over and engages the rear shoulder 194 of the vacuum shoe 90 to help hold the removable shoe 180 on the cleaning head 38 of the wand 36. Again, a tight clearance is all that is necessary to achieve a grip between the shoe 180 and the wand 36, but the clips 182 and 186 may be used as an option or in addition to tight clearances. Although the clips are described as elongate, they may also be formed as a row of independent teeth.

What is claimed is:

1. A removable tool to slip over a portion of the cleaning head of a carpet cleaning wand to allow the wand to also clean hard surface floors, the removable tool comprising:

a body sized and arranged to slip over a bottom portion of the cleaning head of the carpet cleaning wand;

the body having a front bar, a middle bar and a rear bar, the bars connected by a left and a right side walls;

a front elongate elastomeric squeegee blade depending from the front bar and positioned generally adjacent a forward edge of a vacuum shoe;

a rear elongate elastomeric squeegee blade depending from the middle bar and positioned generally adjacent a rear edge of the vacuum shoe; and a plurality of brushes depending from the rear bar for scrubbing the hard surface floor.

2. The apparatus of claim 1 wherein the front squeegee blade and the rear squeegee blade are removable.

3. The apparatus of claim 1 further including a pair of springs, one end of each spring releasably connected to the tool and the other end of each spring releasably connected to the cleaning head to help hold the tool to the cleaning head of the carpet cleaning wand.

4. The apparatus of claim 1 further including a first clip running along a trailing edge of the front bar and a second opposing clip running along a leading edge of the middle bar, the clips sized and arranged to engage opposing shoulders of the vacuum shoe, to help hold the tool to the cleaning head of the carpet cleaning wand.

5. A dual purpose floor cleaning apparatus capable of cleaning both carpet and hard surfaced floors, the apparatus comprising:

a movable housing containing a solution tank, a recovery tank, at least one solution pump, and at least one vacuum pump;

a hand held elongate wand having a cleaning head in contact with the floor to deliver cleaning solution to the floor and an elongate vacuum shoe to remove dirty solution from carpeted floors;

a plurality of flexible conduits connecting the hand held cleaning wand to the movable housing, one conduit delivering a cleaning solution from the solution tank to the wand and another conduit transporting dirty solution from the wand to the recovery tank;

a removable tool to slip over a portion of the cleaning head of the wand, to convert the carpet cleaning wand into a device suitable for cleaning hard surfaced floors, the removable tool including a front and a rear elongate elastomeric squeegee blade generally surrounding the elongate vacuum shoe to remove dirty solution from the hard surfaced floor and a brush to enable scrubbing of the hard surface floor when the tool is affixed to the wand; and a pair of springs, one end of each spring releasably connected to the tool and the other end of each spring releasably connected to the cleaning head to help hold the tool to the cleaning head of the carpet cleaning wand.

6. The apparatus of claim 5 further including a heater to heat the cleaning solution before contact with the floor.

7. The apparatus of claim 5 wherein the front and rear elongate elastomeric squeegee blades are removable.

8. The apparatus of claim 5 further including a first clip running along a trailing edge of the front bar and a second opposing clip running along a leading edge of the middle bar, the clips sized and arranged to engage opposing shoulders of the vacuum shoe, to help hold the tool to the cleaning head of the carpet cleaning wand.

9. In combination a hand held elongate carpet cleaning wand and a selectively removable tool to slip over a portion of a head of the carpet cleaning wand to convert the carpet cleaning wand into a device that is also suitable for cleaning a hard surfaced floor comprising:

the hand held elongate carpet cleaning wand having a cleaning head in contact with the floor to deliver solution to the floor, the head further having a elongate vacuum shoe to remove dirty solution from a carpeted floor; and a removable tool to selectively slip over a portion of the cleaning head of the wand, to convert the carpet cleaning wand into a device suitable for cleaning a hard surfaced floor, the removable tool including a front and a rear elongate elastomeric squeegee blade generally surrounding the elongate vacuum shoe to remove dirty solution from the hard surfaced floor and a brush to enable scrubbing of the hard surface floor when the tool is affixed to the wand; and a pair of springs, one end of each spring releasably connected to the tool and the other end of each spring releasably connected to the cleaning head to help hold the tool to the cleaning head of the carpet cleaning wand.

10. The apparatus of claim 9 wherein the front and rear elongate elastomeric squeegee blades are removable.

11. The apparatus of claim 9 further including a first clip running along a trailing edge of the front bar and a second opposing clip running along a leading edge of the middle bar, the clips sized and arranged to engage opposing shoulders of the vacuum shoe, to help hold the tool to the cleaning head of the carpet cleaning wand.

* * * * *

UNITED STATES PATENT AND TRADEMARK OFFICE

CERTIFICATE OF CORRECTION

PATENT NO. : 7,617,564 B2
APPLICATION NO. : 11/163110
DATED : November 17, 2009
INVENTOR(S) : Billy Joe Stuthers It is certified that error appears in the above-identified patent and that said Letters Patent is hereby corrected as shown below:

Col. 4, line 12, delete "unshaped" and replace with -- u-shaped --

Col. 4, line 14, delete "unshaped" and replace with -- u-shaped --

Signed and Sealed this

Fifth Day of January, 2010

David J. Kappos

David J. Kappos
*Director of the United States Patent and Trademark Office*